United States Patent [19]

Wilson

[11] Patent Number: 4,949,069

[45] Date of Patent: Aug. 14, 1990

[54] DYNAMIC LIQUID LEVEL INDICATOR

[75] Inventor: Carl R. Wilson, Texico, Ill.

[73] Assignee: Sparton Corporation, Jackson, Mich.

[21] Appl. No.: 269,122

[22] Filed: Nov. 9, 1988

[51] Int. Cl.[5] ..... G08B 21/00

[52] U.S. Cl. ..... 340/450.1; 340/620

[58] Field of Search ..... 340/450, 450.1, 450.2, 340/450.3, 620; 73/304 R, 290 R

[56] References Cited

U.S. PATENT DOCUMENTS

| | | | |
|---|---|---|---|
| 3,938,117 | 2/1976 | Bozoian | 340/450 |
| 3,967,238 | 6/1976 | Ridpath et al. | 340/620 X |
| 4,001,676 | 1/1977 | Hile et al. | 340/450 |
| 4,356,480 | 10/1982 | Dressler | 340/620 |
| 4,367,462 | 1/1983 | Dressler | 340/620 |
| 4,385,290 | 5/1983 | Fiala | 340/620 |
| 4,503,419 | 3/1985 | Kidd et al. | 340/620 X |
| 4,513,277 | 4/1985 | Moore et al. | 340/450 |
| 4,584,554 | 4/1986 | Weiss | 340/620 X |

*Primary Examiner*—Hezron E. Williams

*Attorney, Agent, or Firm*—Reising, Ethington, Barnard, Perry & Milton

[57] ABSTRACT

A liquid level indicator uses a conductive probe and when the circuit is energized a logic signal indicates whether the liquid is above or below a certain level. The signal is processed by a logic circuit and the output of the logic circuit controls an indicator circuit. An inhibit circuit provides an input to the logic circuit and prevents the indicator circuit from indicating low liquid within a start time delay period after energization of the sensing circuit. The logic circuit includes a time constant circuit which interposes time delays in the logic signal output of the logic circuit to prevent false indications from momentary changes in liquid level.

13 Claims, 1 Drawing Sheet

DYNAMIC LIQUID LEVEL INDICATOR

FIELD OF THE INVENTION

This invention relates to fluid level indicators; more particularly it relates to liquid level indicators especially adapted for use on automotive vehicles.

BACKGROUND OF THE INVENTION

Liquid level indicators are useful in a wide variety of applications and are known in a variety of different types. One type of level indicator which may be referred to as an analog indicator is capable of displaying the variable height of liquid in a container ranging, for example, between empty and full. This type of indicator is well known for use as a gasoline gage in automotive vehicles. Another commonly used type of liquid level indicator is that which signifies whether the level of liquid in a container is above or below a predetermined level. This type may be termed digital or "low" liquid level indicator.

The low liquid level indicator is useful in industrial machines, processing plants and in automotive vehicles for indicating whether or not a liquid level in a container is above or below a desired level. There is a need for an improved low liquid level indicator which will provide a reliable level indication under dynamic conditions. A dynamic liquid level indicator, as the term is used herein, means an indicator which is adapted to provide a level indication while there is relative movement between the liquid and its container such as splashing, sloshing, vibration and tilting. On the other hand, a static liquid level indicator, as the term is used herein, means one which is adapted to provide a level indication when there is no significant relative movement between the liquid and its container.

In certain applications, it is highly desirable to provide liquid level indication under dynamic conditions which result, for example, during operation of industrial machines or operation of an automotive vehicle. This is especially true where the machine or vehicle would be damaged or unsafe if operation is continued with a low level liquid such as liquid coolant, hydraulic fluid or liquid lubricant. In such cases, a static liquid level indicator is not adapted to provide a warning signal or indication in time to avoid operation under damaging or unsafe conditions.

In automotive vehicles, the liquid level in a container, such as the crankcase oil in the oil pan, will change at the location of a sensor probe with the tilting of the vehicle on a turn, the change of attitude of the vehicle on an upgrade and downgrade and in response to motion of the vehicle induced by bumps and the like. Unless special provision is made, a liquid level indicator will produce false indications under dynamic conditions. In the case of some liquid level indicator applications, a false indication may be induced by other operating conditions. For example, in the case of engine crankcase oil the oil level should be measured when the engine is warmed up so that there is consistently repeatable drain back of the oil from the engine passages into the oil pan. With the engine running and properly warmed up, a reliable indication of proper oil level can be obtained by appropriate placement of the level sensor probe in the oil pan. In this condition a better indication of oil level can be obtained than in the case of a cold engine where the amount of oil in the engine lubricating passages is variable or indeterminate.

The prior art includes many different forms liquid level indicators. The Ridpath et al U.S. Pat. No. 3,967,238 granted June 29, 1976 discloses a liquid level indicator for brake fluid in the master cylinders of a vehicle. A resistive probe is used in the liquid container and produces a signal which is proportional to the level of the liquid. A detector circuit includes a threshold detector to provide for switching at a discrete voltage level to produce a logic signal which controls the switching of an indicator lamp. An integrating network prevents transient voltage signals caused by sudden fluid level changes due to a change in attitude of the vehicle or splashing of the liquid.

The Dressler U.S. Pat. No. 4,356,480 granted Oct. 26, 1982 describes a liquid level indicator which provides indication of oil level during engine operation. This device. uses a conductive probe which produces a logic signal depending upon whether or not the probe is in contact with the oil. A latch circuit is provided with a clock input from a one-shot which clocks the oil level logic signal into the latch for storage. The one-shot has a clock input and when the ignition switch is closed it supplies a clock signal through a delay circuit to the clock input of the one-shot. The time delay is a small fraction of a second and allows the sensor signal to stabilize before the clock signal is applied to the latch. The one-shot is also provided with a time delay circuit which supplies a reset signal to the one-shot after a delay of thirty or forty seconds following the clock signal produced by closing the ignition switch. This time delay insures that the oil level reading, which is taken when the ignition switch is first turned on, is retained in the latch even though the engine does not start the first time and the ignition switch is turned on again within the time delay interval.

The Dressler U.S. Pat. No. 4,367,462 granted Jan. 4, 1983 and the Fiala U.S. Pat. No. 4,385,290 granted May 24, 1983 disclose liquid level sensing circuitry adapted for low oil level indication for a vehicle. In the systems of these two patents, an electronic circuit checks the oil level just after the engine is turned off and a logic signal is memorized to indicate whether the oil level is acceptable or unacceptable. Then, when the engine is later restarted, the oil level condition is indicated. This provides for measurement of the oil level after the engine is warmed up but it provides the indication to the driver upon restarting before the engine is warmed up. This system takes a reading of the oil level with the engine turned off and hence it is a static level indicator.

In the Kidd et al U.S. Pat. No. 4,503,419 granted Mar. 5, 1985, an oil level detection circuit detects oil level in the engine crankcase immediately after the ignition switch is turned on. An enabling circuit allows an output to the indicator only if the ignition switch has been turned off for a sufficient time period to allow the oil to drain back to the crankcase.

The Weiss U.S. Pat. No. 4,584,554 granted Apr. 22, 1986 discloses an engine oil level detecting device which uses a resistive probe to develop the voltage which varies according to the immersion of the probe in the oil. The voltage is applied to a galvanometer to indicate the oil level. A timer circuit maintains the signal to the galvanometer for a period of time after the ignition switch is closed so that the indication will not be changed by starting the engine and pumping of the oil.

A general object of this invention is to provide an improved dynamic liquid level indicator which overcomes certain disadvantages of the prior art.

SUMMARY OF THE INVENTION

In accordance with this invention, there is provided a dynamic liquid level indicator of the low liquid level indicating type. More particularly, the dynamic indicator is capable of providing a reliable indication of whether the level is above or below a desired level while there is relative movement such as sloshing, tilting and the like between the liquid and its container. This is accomplished by providing an electronic control circuit for the indicator which interposes certain time delays before the indicator signal is allowed to change its state.

In accordance with the invention, the liquid level indicator comprises a sensing circuit which, when energized, is responsive to a liquid level for producing a first logic signal having a logic state indicative of whether the liquid is above or below a predetermined level. A logic circuit is responsive to the first logic signal and produces a second logic signal having a logic state indicative of the liquid level and an indicator circuit is responsive to the second logic signal. In order to prevent the indicator circuit from giving a false low level indication due to a short term or transient change of liquid level, the logic circuit includes means for preventing a change of the indication within a predetermined first time delay. Also, if desired, the logic circuit includes means for preventing indication of a satisfactory liquid level due to short term or transient changes by preventing a change of the indication within a predetermined second time delay.

Further, in accordance with this invention, a dynamic liquid level indicator is provided which is especially adapted for use as an engine crankcase oil level indicator. The inventive indicator provides an oil level indication on a continuous basis during engine operation but only after the engine is warmed up.

Further, according to the invention, a sensing circuit which is responsive, when energized, to the engine oil level produces a first logic signal indicative of whether the engine oil level is above or below the desired level. An energizing circuit including a voltage source and a switch energizes the sensing circuit when the switch is closed. A logic circuit is responsive to the first logic signal for producing a second logic signal which controls an indicator circuit. Inhibiting means are provided for holding the second logic signal in a logic state indicative of satisfactory oil level for a predetermined time after the sensing circuit is energized to allow the engine to be warmed up. After that time period, the indicator circuit will produce a low oil level indication, as by turning on a warning lamp, only if there is a low oil condition. Additionally,, the logic circuit is provided with means for allowing a change of the indicator signal only after a certain time delay so that false low oil signals are not produced by short term or transient shifting of the oil in the oil pan.

A complete understanding of this invention may be obtained from the detailed description that follows taken with the accompanying drawings.

BEST MODE FOR CARRYING OUT THE INVENTION

Figure 1:
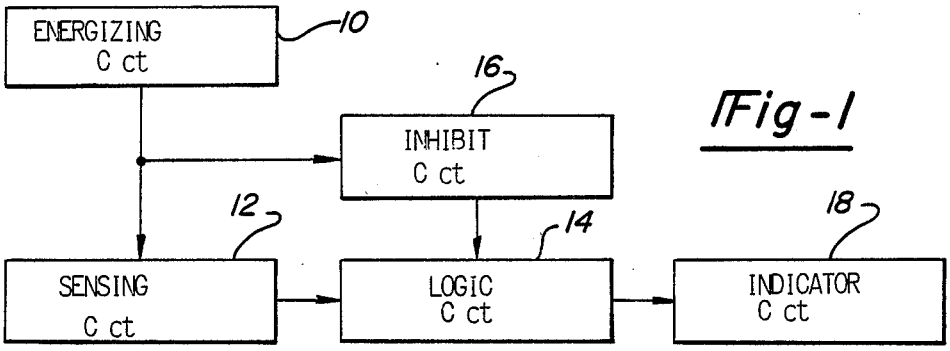
FIG. 1 is a block diagram of the inventive liquid level indicator.

Referring now to the drawings, there is shown an illustrative embodiment of the invention in a dynamic liquid level indicator of the low level indicating type. The illustrative embodiment is especially adapted for indicating low oil level in the crankcase oil pan of an automotive vehicle. It will be appreciated as the description proceeds that the invention is useful in many different applications and may be realized in different embodiments.

The liquid level indicator of this invention is shown in the block diagram of FIG. 1. It comprises a sensing circuit 12 which, when energized, is adapted to produce a logic signal indicating whether the liquid level is above or below a predetermined level. An energizing circuit 10 comprises a voltage source and switch and is adapted to provide a supply voltage to the sensing circuit and probe as well as the other circuit stages of the system. The output signal of the sensing circuit 12 is applied as one input to a logic circuit 14. An inhibit circuit 16 receives an input from the energizing circuit 10 and its output signal is applied to another input of the logic circuit 14. The inhibit circuit 16 operates to inhibit the output of the logic circuit 14 from indicating low liquid level until after a start-up time delay. The logic circuit 14 produces an output logic signal which is applied to the input of the indicator circuit 18. The indicator circuit 18 includes an indicator, suitably a warning light, to notify the operator of a low liquid level condition. The logic circuit 14, as will be described subsequently, is operative to prevent false indications from being produced by the indicating circuit 18 in response to transient movements of the liquid in its container.

In the illustrative embodiment of the invention, a conductive probe is used in the sensing circuit. A conductive probe is especially well suited for use in detecting the level of crankcase oil in an engine; however, in other applications of the liquid level indicator, another type of probe such as a capacitive probe may be more suited, depending upon the liquid.

Figure 3:
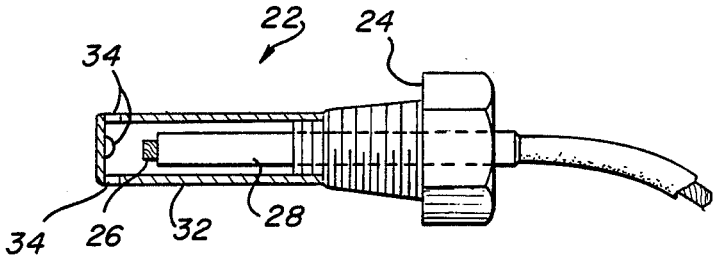
FIG. 3 shows a probe especially adapted for use with this invention.

A conductive probe 22 which is part of the sensing circuit 12 is shown in FIG. 3. The probe comprises a metal body 24 which insulatingly supports a probe conductor 26. The conductor is provided with an insulating sleeve 28 which covers all of the conductor except for the tip which is adapted to be in contact with the liquid being sensed. The conductor 26 is enclosed within a cylindrical shield 32 which is mounted on the body 24. The shield 32 is imperforate except for a set of holes 34 which is disposed at the end of the shield near the tip of the conductor 26. The holes provide for inflow and outflow of liquid from the shield. The shield is effective to block splashing and sloshing liquid from making direct contact with the tip of the conductor 26. The probe body 24 suitably provided with a threaded shank and a nut so that it may be installed in the vertical wall of a liquid container at a height or level which is the low level to be indicated by the liquid level indicator. In the illustrative embodiment, the probe 22 is installed in the side wall of the crankcase oil pan of a vehicle engine at the low oil level in the pan.

Figure 2:
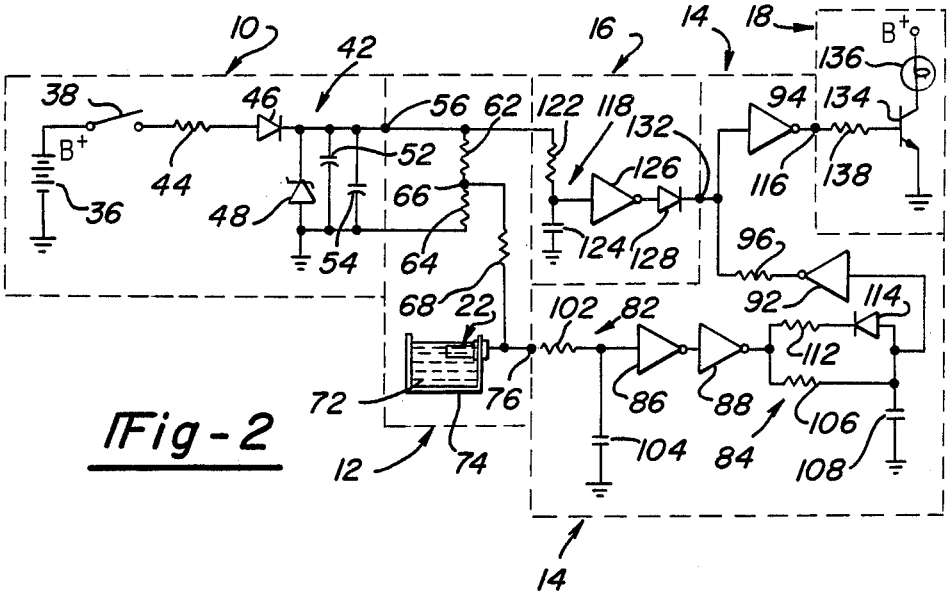
FIG. 2 is a schematic diagram of the liquid level indicator.

The liquid level indicator will now be described in detail with reference to the schematic diagram of FIG. 2. The energizing circuit 10 comprises the vehicle battery 36, the vehicle engine ignition switch 38 and a voltage regulator 42. The battery 36 has its negative terminal connected to ground and its positive or B+ terminal connected through the ignition switch 38, a limiting resistor 44 and a protective diode 46 to the voltage regulator 42. The regulator 42 comprises a zener diode 48 connected between the cathode of the diode 46 and ground. It also comprises a pair of parallel filter capacitors 52 and 54. When the ignition switch 38 is closed, the voltage regulator supplies a substantially constant supply voltage at the circuit node 56 for energizing the remainder of the circuits of the liquid level indicator.

The sensing circuit 12 comprises a pair of voltage divider resistors 62 and 64 which are connected in series across the voltage supply node 56 to obtain the desired voltage at the circuit node 66. A sensing resistor 68 and the oil 72 in the oil pan 74 are connected in series through the probe 22 across the circuit node 66 and ground. This circuit is completed only when the tip of the probe conductor 26 is submerged in the oil 72. As indicated, the oil pan 74 is connected to ground. The sensing circuit 12 is energized only when the ignition switch 38 is closed and hence, there is no drain on the battery except during engine operation. When the oil level in the pan 74 is low, the conductor 26 of the probe 22 is out of contact with the oil 72 and the voltage at the circuit node 76 is substantially equal to the supply voltage at the node 66. When the conductor 26 is submerged in the oil 72, the resistor 68 forms a voltage divider with the resistance of the oil; however, the resistor 68 has a resistance several times larger than that of the oil and consequently the voltage at the node 76 is only slightly above the ground voltage. Thus, the output of the sensing circuit 12 taken at the node 76 is a logic signal which is at logic high when the oil level is low and it is at logic low when the oil level is high enough to submerge the conductor 26 of the probe 22. This logic signal at node 76 is applied to the input of the logic circuit 14.

The logic circuit 14 comprises an input filter 82 which is coupled through a pair of logic gates in the form of inverters 86 and 88 to a time constant circuit 84. The output of the time constant circuit is coupled through an inverter 92 and a resistor 96 to the input of an inverter 94 which produces the output signal of the logic circuit. The filter 82 comprises a series resistor 102 and a shunt capacitor 104 and functions to eliminate unwanted or spurious voltages from the input of the logic circuit. The logic signal is applied from the filter to the time constant 84 through inverters 86 and 88 which are cascade connected and present a high input impedance. The output of inverter 88 coupled to the time constant circuit 84 which comprises a resistor 106 and a capacitor 108 connected in series to ground. It also comprises a series combination of a resistor 112 and diode 114 connected in parallel across the resistor 106. The diode 114 has its anode connected with the junction of capacitor 108 and resistor 106. The resistor 106 and capacitor 108 comprise a first time constant circuit with a first time delay for charging the capacitor 108 when the output of the inverter 88 is high. When the output of inverter 88 is low, the capacitor 108 is discharged into a second time constant circuit with a second time delay through the resistor 106 and the parallel connection of diode 114 and resistor 112.

The output of the time constant circuit 84, taken across capacitor 108, is applied through the inverter 92 and series resistor 96 to the input of inverter 94. The output of the inverter 94 is a logic signal at circuit node 116 which constitutes the output of the logic circuit 14. The logic signal at node 116 is applied to the input of the indicator circuit 18; however, the logic circuit 14 is also controlled by the inhibit circuit 16 which will now be described.

The inhibit circuit 16 controls the output of the logic circuit 14 until a predetermined start-up time period has elapsed. For this purpose, it has its input connected to the node 56 of the energizing circuit 10 and its output is connected to the input of the inverter 94. The inhibit circuit 16 comprises a time constant circuit 118, an inverter 126 and a diode 128. The time constant circuit 118 comprises a resistor 122 and a capacitor 124 connected between the circuit node 56 and ground. The input of the inverter 126 is connected to the junction of the resistor 122 and capacitor 124 and the output thereof is applied through diode 128 to the circuit node 132. When the ignition switch 38 is initially closed, the voltage across the capacitor 124 is low and the output of inverter 126 is high and hence the voltage at node 132 is at logic high. After a predetermined time period from closing the ignition switch 38, the voltage across the capacitor 124 will reach a logic high level and the output of the inverter 126 and hence the voltage at the node 132 will be at logic low. The logic signal at node 132 is applied to the input of the inverter 94.

The indicator circuit 18 has its input connected with the circuit node 116 at the output of the logic circuit 14. The indicator circuit comprises a transistor 134 and an indicator which takes the form of an incandescent lamp 136. The base of the transistor 134 is coupled to the circuit node 116 through a resistor 138 and the emitter of the transistor is connected to ground. The collector of the transistor is connected through the lamp 136 to the positive terminal B+on the battery 36. When the logic signal at node 116 is at logic high, the transistor 134 is turned On and the lamp 136 is turned on. When the logic signal at node 116 is at logic low, the transistor 134 is turned off and the lamp 136 is turned off.

The operation of the liquid level indicator will now be described with reference to FIG. 2. First, it will be assumed that the oil 72 in the oil pan 74 is at a high enough level when the engine is cold so that the conductor tip of the probe 22 is submerged. When the ignition switch 38 is turned on, the regulated supply voltage is developed at circuit node 56. Because of the voltage division between sensing resistor 68 and the resistance of the oil 72, a logic low voltage is developed at circuit node 76. This logic signal is applied through the filter 82 to the inverter 86 which develops a logic high at its output and consequently inverter 88 develops a logic low at its output. At this point, the capacitor 108 in the time delay circuit with resistor 106 is discharged and the voltage thereacross is at logic low and will remain low. This voltage is applied to the input inverter 92 which develops a logic high at its output and the logic high is applied through resistor 96 to the input of the inverter 94. Also, the output of the inhibit circuit 16 at node 132 is applied to the input of the inverter 94. For a predetermined time period after closure of the ignition switch 38 the voltage at the node 132 remains low. This obtains because the time constant circuit 118 requires a predetermined time period, herein called a start time delay, before the capacitor 124 is charged from a logic low to a logic high level. When the voltage across the capacitor is logic low, the voltage applied through inverter 126 and diode 128 to node 132 is logic high. This is applied to the input of inverter 94 along with the logic high output of inverter 92 and accordingly the output voltage of inverter 94 at node 116 is at logic low. After the inhibit circuit 16 has timed out and the voltage across the capacitor 124 becomes logic high, the inverter 126 has a logic low output and this output is blocked by the diode 128. Accordingly, under the conditions described, the input to inverter 94 is uneffected by the output of the inhibit circuit 16 at node 132 and inverter 94 is controlled by the logic high output of inverter 92 and therefore the voltage at node 116 remains at logic low. As a result the transistor 134 is in the off condition and the indicator lamp 136 is off.

If, during engine operation and after the start time delay described above, the vehicle should turn a corner which tilts the vehicle so that the probe 22 is momentarily not submerged, the logic signal at node 76 will go to logic high. This causes the output of inverter 86 to go to logic low and the output of inverter 88 to go to logic high. Accordingly, the capacitor 108 will start to charge through resistor 106 and the voltage will increase toward the logic high level. However, the resistor 106 and capacitor 108 have a predetermined time constant such that false signalling of low oil level will be avoided. For this purpose, the voltage across capacitor 108 will require a first predetermined time delay, say about thirty seconds, before it changes from logic low to logic high. During that time delay, the attitude of the vehicle will normally be restored to a more level condition and the probe 22 will be submerged again before the logic signal changes state across capacitor 108. Accordingly, during this first time delay the logic signal at node 116 is unchanged and the indicator lamp 136 remains turned off.

If on the other hand, during the continued operation of the engine and after the start time delay period, the level of the oil 72 falls below the probe 22 due to depletion of the oil supply, the logic signal at node 76 will go to logic high. This will cause the output of inverter 86 to go to logic low and the output of inverter 88 to go to logic high. After the predetermined time delay period, the voltage across capacitor 108 will go to logic high and the output of the inverter 92 will become logic low. Accordingly, the output of inverter 94 becomes logic high and the transistor 134 is turned on. This causes the indicator 136 to be turned on. The switching on of the lamp 136 during vehicle operation is readily noticeable by the vehicle operator and serves as a warning that corrective action must be taken.

If during continued operation of the vehicle under conditions previously described, the vehicle encounters a steep hill, the probe 22 may be momentarily submerged in oil. As a result, the logic signal at node 76 will momentarily go to logic low. This will cause the output of inverter 88 to go logic low and the capacitor 108 will start to discharge from its logic high level toward logic low. The discharge path for the capacitor includes the resistor 106 and the parallel path through diode 114 and resistor 112. This interposes a second predetermined time delay, for example about one minute, before the logic signal at the capacitor 108 changes state. During this second time delay, under ordinary conditions the vehicle will have returned to a more level condition in which the probe 22 is not submerged and the logic signal at node 76 will switch back to logic high. Accordingly, the logic signal at node 116 will remain unchanged during the second time delay and the indicator lamp 136 will remain on during the momentary change of the logic signal at node 76.

If the engine is turned off and later restarted subsequent to the conditions previously described without oil being added to the pan 74, the logic signal at node 76 will be at logic high and after the first time delay, the logic signal at the output of inverter 92 will be at logic low. However, during the start time delay period of the inhibit circuit 16, the logic signal at node 132 will be at logic high. Consequently, due to resistor 96, the input to the inverter 94 will be at logic high and the output thereof at node 116 will be at logic low. Accordingly, during the start time delay period the indicator lamp 136 will be off. After the start time delay period, the voltage at node 132 will become logic low and the signal at node 116 will become logic high. This will turn on the transistor 134 and the indicator lamp 136.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A liquid level indicator comprising:

a sensing circuit responsive, when energized, to a liquid level for producing a first logic signal having one logic state when the liquid is above a predetermined level and another logic state when the liquid is below said predetermined level, an energizing circuit coupled with said sensing circuit and including a voltage source and a switch for energizing said sensing circuit, a logic circuit coupled with said sensing circuit and responsive to said first logic signal for producing a second logic signal in a first logic state in response to said first logic signal being in said one logic state and for producing said second logic signal in a second logic state in response to said first logic signal being in said another logic state, an indicator circuit coupled with said logic circuit and responsive to said second logic signal in said first logic state for signifying that said liquid is above said predetermined level and responsive to said second logic signal in said second logic state for signifying that said liquid is below said predetermined level, and inhibiting means responsive to energization of said sensing circuit and coupled with said logic circuit for holding said second logic signal in said first logic state for a predetermined time period after said sensing circuit is energized.

2. A liquid level indicator as defined in claim 1 wherein:

said sensing circuit comprises a probe having an electrical element and being adapted to be mounted in a container for liquid and at a position having a known relation to said predetermined level, said probe being subject to submersion in the liquid, said probe including a shield enclosing said element and being imperforate except for a set of holes for inflow of said liquid when the probe is submerged and for outflow of said liquid when the probe is not submersed.

3. The liquid level indicator as defined in claim 1 wherein said logic circuit includes:

means for preventing said second logic signal from changing to said second logic state within a first time delay after a change of said first logic signal from said one to said another logic state.

4. The liquid level indicator as defined in claim 1 wherein said logic circuit includes:

means for preventing said second logic signal from changing to said first logic state within a second time delay after a change of said first logic signal from said another to said one logic state.

5. A liquid level indicator as defined in claim 1 wherein said logic circuit includes:

means for preventing said second logic signal from changing to said second logic state within a first time delay after a change of said first logic signal from said one to said another logic state and means for preventing said second logic signal from changing to said first logic state within a second time delay after a change of said first logic signal from said another to said one logic state.

6. A liquid level indicator comprising:

a sensing circuit responsive to a liquid level for producing a first logic signal having one logic state when the liquid is above a predetermined level and another logic state when, the liquid is below a predetermined level, a logic circuit coupled with said sensing circuit and responsive to said first logic signal for producing a second logic signal in a first logic state in response to said first logic signal being in said one logic state, and for producing said second logic signal in a second logic state in response to said first logic signal being in said another logic state, said logic circuit including means for preventing said second logic signal from changing to said second logic state within a first time delay after a change of said first logic signal from said one to said another logic state and for preventing said second logic signal from changing to said first logic state within a second time delay after a change of said first logic signal from said another to said one logic state, and an indicator circuit coupled with said logic circuit and responsive to said second logic signal in said first logic state for signifying that said liquid is above said predetermined level and responsive to said second logic signal in a second logic state for signifying that said liquid is below said predetermined level.

7. A liquid level indicator as defined in claim 6 wherein:

said sensing circuit includes a probe having an electrical element and being adapted to be mounted in a container for liquid and at a position having a known relation to said predetermined level, said probe being subject to submersion in the liquid, said probe including a shield enclosing said element and being imperforate except for a set of holes for inflow of said liquid when the probe is submerged and for outflow of said liquid when the probe is not submerged.

8. A liquid level indicator as defined in claim 7 including:

an energizing circuit coupled with said sensing circuit and including a voltage source and a switch for energizing said sensing circuit, and inhibiting means responsive to energization of said sensing circuit and coupled with said logic circuit for holding said second logic signal in said first logic state for a predetermined time period after said sensing circuit is energized.

9. A liquid level indicator for use on an automotive vehicle comprising:

a container for liquid mounted on said vehicle, a probe having an electrical element and being adapted to be mounted in said container with said electrical element at a predetermined level, said probe being subject to submersion in the liquid, and including a shield enclosing said element, said shield being imperforate except for a set of holes for inflow of said liquid when the probe is submerged and for outflow of said liquid when the probe is not submerged, a sensing circuit including said element and being responsive, when energized, to a liquid level for producing a first logic signal having one logic state when the liquid is above said predetermined level and another logic state when the liquid is below said predetermined level, a logic circuit coupled with said sensing circuit and responsive to said first logic signal for producing a second logic signal in a first logic state in response to said first logic signal being in said one logic state and for producing said second logic signal in a second logic state in response to said first logic signal being in said another logic state, and an indicator circuit coupled with said logic circuit and responsive to said second logic signal in said first logic state for signifying that said liquid is above said predetermined level and responsive to said second logic signal in said second logic state for signifying that said liquid is below said predetermined level, said logic circuit including time delay means for preventing said second logic signal from changing to said second logic state within a first time delay after said first logic signal changes to said another logic state and for preventing said second logic signal from changing to said first logic state within a second time delay after said first logic changes to said one logic state.

10. The invention as defined in claim 9 including:

an energizing circuit coupled with said sensing circuit and including a voltage source and a switch for energizing said sensing circuit, and inhibiting means responsive to energization of said sensing circuit and coupled with said logic circuit for holding said second logic signal in said first logic state for a predetermined time period after said sensing circuit is energized.

11. A liquid level indicator as defined in claim 9 wherein:

said time delay means includes a time constant circuit, and said logic circuit also includes first and second logic gates, said gates being coupled in cascade relation through said time constant circuit.

12. A liquid level indicator as defined in claim 11 wherein:

said logic circuit includes third and fourth logic gates, said second logic gate having its output coupled with the input of said third logic gate, and said inhibiting means comprises a resistor and capacitor connected across said voltage source, said fourth logic gate having its input connected with the junction of said resistor and capacitor and its output connected through a diode to the input of said third logic gate.

13. A liquid level indicator as defined in claim 12 wherein said time constant circuit includes a first resistor, a diode and a capacitor in series connection and a second resistor in parallel connection with the first resistor and diode.

* * * * *